United States Patent [19]

Child

[11] Patent Number: 4,588,362

[45] Date of Patent: May 13, 1986

[54] REVERSIBLE UNIDIRECTIONAL FLOW ROTARY PUMP

[75] Inventor: Robin E. Child, Leamington Spa, United Kingdom

[73] Assignee: Concentric Pumps Limited, Erdington, United Kingdom

[21] Appl. No.: 695,866

[22] PCT Filed: Sep. 3, 1984

[86] PCT No.: PCT/GB84/00306

§ 371 Date: Jan. 21, 1985

§ 102(e) Date: Jan. 21, 1985

[87] PCT Pub. No.: WO85/01086

PCT Pub. Date: Mar. 14, 1985

[30] Foreign Application Priority Data

Sep. 8, 1983 [GB] United Kingdom ..... 8324116

[51] Int. Cl.[4] ..... F04C 2/10; F04C 15/02

[52] U.S. Cl. ..... 418/32; 418/171

[58] Field of Search ..... 418/32, 166, 171; 417/315

[56] References Cited

U.S. PATENT DOCUMENTS 2,373,368 4/1945 Witchger ..... 418/32

3,034,447 5/1962 Brundage ..... 418/171

3,583,839 6/1971 Brundage ..... 418/171

FOREIGN PATENT DOCUMENTS 828115 2/1960 United Kingdom ..... 418/32

*Primary Examiner*—John J. Vrablik

*Attorney, Agent, or Firm*—C. O. Marshall, Jr.

[57] ABSTRACT

A gerotor pump is arranged for unidirectional flow irrespective of direction of rotation of the pump by arranging for displacement of the axis of eccentricity of the annulus and rotor upon drive reversal, the annulus being mounted in a carrier 14, FIG. 1, with freedom for movement in a first direction within the carrier, while the carrier itself is pivoted (24) in an outer housing 15, the carrier being free for movement in a second direction within the housing. The effect of normal drive of the rotor is to hold the parts in the FIG. 1 position while pumping continues, but in the event of drive reversal a pressure fluctuation causes the annulus to be displaced within the carrier and then the carrier to be displaced within the housing so as to bring the parts to substantially the mirror image of the FIG. 1 position allowing continued pumping in the same direction from inlet to outlet under reversed drive.

1 Claim, 2 Drawing Figures

REVERSIBLE UNIDIRECTIONAL FLOW ROTARY PUMP

This invention relates to a reversible unidirectional flow gerotor pump. Such pumps are used in apparatus where unidirectional pump output is required even if the direction of rotation of the pump is reversed. One example of such a pump is disclosed in our British prior Pat. No. 2,029,905.

Such pumps generally employ a rotatable reversing ring which, in response to reversal of the direction of rotation of the pump, may automatically allow the rotational axis of the pump annulus to orbit through an angle of 180° about the axis of the inner rotor so as to reposition the annulus and thereby maintain unidirectional flow.

One drawback with such pumps results from the need to positively couple the annulus and reversing ring together during such reversals so that the annulus can rotate the reversing ring between diametrically opposite stop positions. Friction alone has not proved entirely satisfactory in practice and this has led to the use of spring loaded couplings between the annulus and the reversing ring as in British Pat. No. 2,029,905 for instance. Experience shows however that such couplings are not wholly satisfactory because they can give rise to problems with wear and they are, in any event, more cumbersome to manufacture and assemble.

According to the present invention we provide a reversible unidirectional flow gerotor pump comprising an inner toothed rotor and an internally toothed annulus which meshes with the inner rotor and rotates about an axis which is eccentrically related to the rotor axis, the annulus being rotatable in a reversing carrier ring located in a pump body, and the axis of the annulus being movable between a pair of operative positions in one of which liquid is pumped in a predetermined direction during rotation of the rotor and annulus in one direction and in the second of which liquid is pumped in the same direction during rotation of the rotor and annulus in the opposite direction, characterised in that the reversing carrier ring is supported in the pump body to pivot between positions providing two seating positions for the annulus corresponding respectively to said pair of operative positions.

Figure 1:
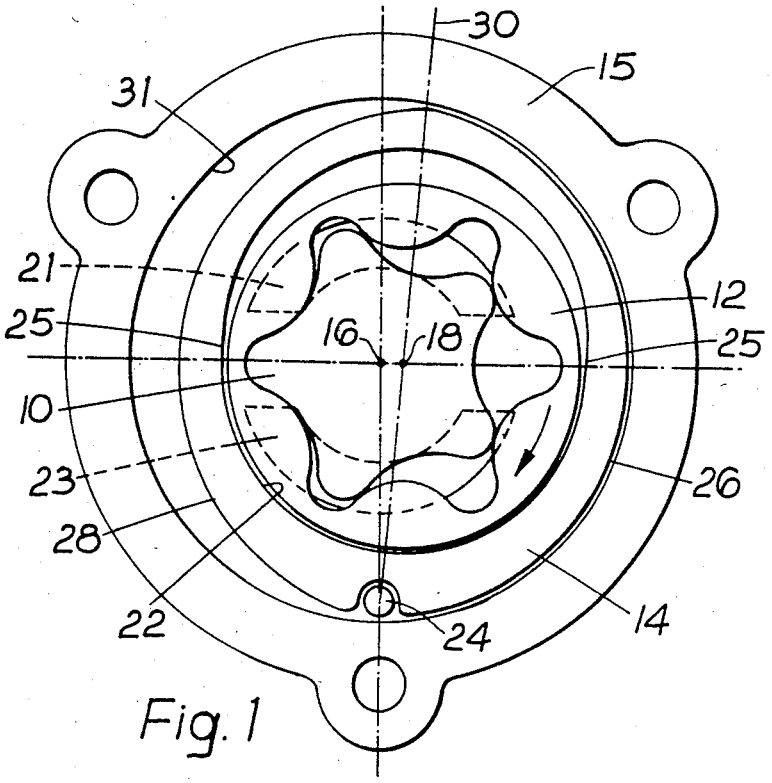
FIG. 1 is a sectional view of a gerotor pump in accordance with the invention, the pump being shown in its normal operative condition with the rotor and annulus rotating clockwise.

The pump in FIG. 1 comprises an inner toothed rotor 10, an annulus 12 having one extra tooth, a carrier 14 which supports the annulus 12 and an outer housing 15. The axis 16 of the rotor is fixed and is substantially co-axial with an input drive shaft (not shown) coupled to the inner rotor. The axis 18 of the annulus is eccentrically related to the axis 16 and in the condition shown in FIG. 1 the axis 18 is effectively fixed as long as the rotor and annulus rotate clockwise.

The inner periphery of the carrier 14 comprises a lower portion centred on a centre of curvature which substantially coincides with the axis 18 when the annulus is seated within the lower half of the carrier. The upper part of the carrier is centred on a centre of curvature which is vertically offset from that of the lower half and the two halves are joined by planar intermediate sections 25 so that the bore of the carrier is slightly elongated in a vertical direction to afford the annulus a certain degree of radial freedom in that direction relative to the axis 16. This radial freedom is of no significance in normal clockwise rotation of the annulus since the annulus bears (substantially frictionlessly because of hydrodynamic pressure) against the lower half 22 of the carrier. The pump creates a unidirectional liquid flow from inlet port 21 to outlet port 23.

The carrier 20 is movable about a fulcrum 24 between a first slightly tilted position as seen in FIG. 1 and a second position in substantially mirror image relation to that of FIG. 1 wherein the centre of curvature of the lower half 22 is disposed on the opposite side of the axis 16. The carrier outer periphery is also non-circular and comprises two substantially semi-cylindrical halves 26, 28 which meet at the plane 30 and are centered on different centres of curvature so that, in each tilted position, one half 26 or 28 bears against, and is substantially complementary to, the cylindrical inner periphery 31 of the outer housing 15. Because the carrier 14 is tiltable in this manner, it will be seen that, with respect to the axis 16, the axis 18 of the annulus 12 is afforded a second position substantially opposite to the first.

Figure 2:
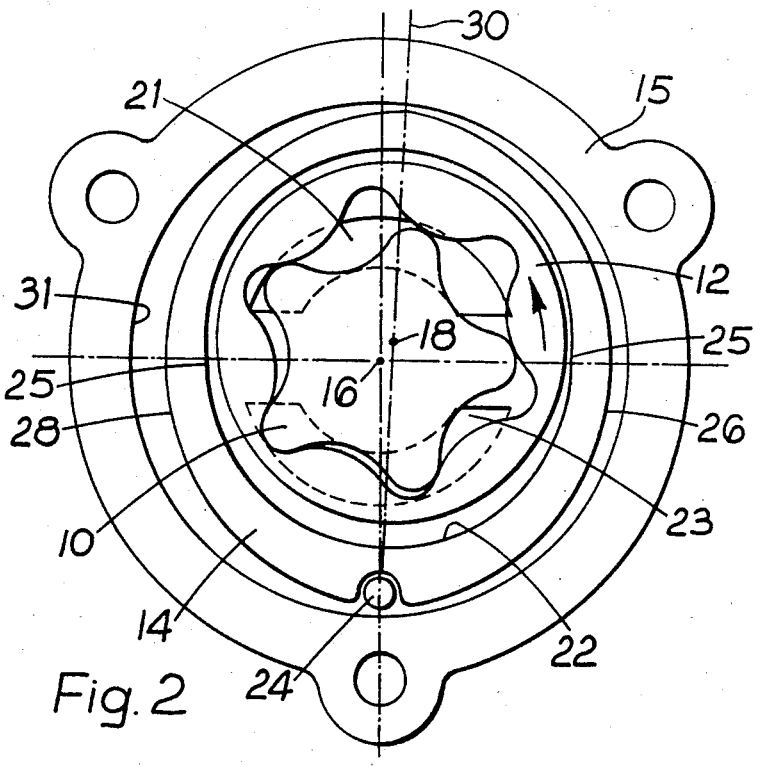
FIG. 2 is a view similar to FIG. 1 but showing the initial stages of transfer of the annulus from one position to another as a result of rotation reversal.

In normal clockwise operation as seen in FIG. 1, the axis 18 of the annulus will be substantially fixed despite the radial freedom available. If however, reversal of drive occurs so that the rotor and hence annulus turn counter-clockwise, there will be a tendency for pressure to develop in the region of inlet port 21 and a suction effect in the region of the outlet port 23. This temporary pressure fluctuation, in conjunction with reverse rotation of the annulus, will initiate shifting of the annulus away from its normal seated position in the lower half 22 of the carrier with consequent tilting of the carrier 20 towards the mirror image position. FIG. 2 illustrates an intermediate point during such shifting of the annulus and the carrier.

When the carrier completes its tilting motion, the annulus can reseat in the lower half 22 and its axis 18 will then be located on the opposite side of the axis 16 thereby allowing unidirectional pumping (from inlet port 21 to outlet port 23) to be maintained despite the drive reversal. It will be noted that the repositioning of the annulus in this manner does not rely upon rotational coupling between the annulus and carrier. If a subsequent drive reversal occurs, the above sequence will take place in reverse to bring the annulus back to the position shown in FIG. 1.

I claim:

1. A reversible unidirectional flow gerotor pump comprising an externally toothed rotor journaled on a fixed axis, and an annulus having a cylindrical outer surface and having internal teeth in mesh with the externally toothed rotor, wherein the improvement comprises a carrier having an elongated cavity at one end of which is a semi-cylindrical surface in which said annulus has a running fit, and a housing in which said carrier has a pivot in line with the middle of said semi-cylindrical surface, said housing limiting the movement of said carrier to permit said carrier to pivot between two positions in which the axis of said cylindrical annulus is on opposite sides of the axis of said rotor.

* * * * *